United States Patent [19]

Raschke et al.

[11] Patent Number: 4,551,063

[45] Date of Patent: Nov. 5, 1985

[54] MEDIUM-PRESSURE STEAM TURBINE

[75] Inventors: Klaus Raschke; Gerhard Exner, both of Berlin, Fed. Rep. of Germany

[73] Assignee: Kraftwerke Union AG, Mulheim am Rhein, Fed. Rep. of Germany

[21] Appl. No.: 586,262

[22] Filed: Mar. 5, 1984

[30] Foreign Application Priority Data

Mar. 18, 1983 [DE] Fed. Rep. of Germany ..... 3310396

[51] Int. Cl.[4] ..... F01D 5/18

[52] U.S. Cl. ..... 415/115; 416/95; 416/198 A; 415/180

[58] Field of Search ..... 415/115, 116, 117, 180, 415/101; 416/95, 198 A

[56] References Cited

U.S. PATENT DOCUMENTS

| | | | |
|---|---|---|---|
| 2,552,239 | 5/1951 | Warren | 415/180 X |
| 2,656,147 | 10/1953 | Brownhill et al. | 416/198 A X |
| 2,873,087 | 2/1959 | Terrell et al. | 416/198 A X |
| 3,443,790 | 5/1969 | Buckland | 415/115 |
| 3,550,372 | 12/1970 | Craig | 416/95 X |
| 3,551,068 | 12/1970 | Scalzo et al. | 415/115 X |
| 3,575,528 | 4/1971 | Beam | 415/115 X |
| 3,602,605 | 8/1971 | Lee | 415/116 |
| 3,609,057 | 9/1971 | Radtke | 415/115 X |
| 3,826,084 | 7/1974 | Branstrom et al. | 415/115 X |
| 4,265,594 | 5/1981 | Eggmann | 416/198 A X |

FOREIGN PATENT DOCUMENTS

| | | | |
|---|---|---|---|
| 1185415 | 1/1965 | Fed. Rep. of Germany | 416/198 A |
| 897716 | 3/1945 | France | 416/198 A |
| 17121 | 4/1968 | Japan | 416/198 A |
| 341030 | 10/1959 | Switzerland | 416/198 A |
| 579316 | 7/1946 | United Kingdom | 415/180 |
| 597165 | 1/1948 | United Kingdom | 415/180 |
| 988541 | 4/1965 | United Kingdom | 415/115 |
| 1184687 | 3/1970 | United Kingdom | 416/95 |

*Primary Examiner*—Everette A. Powell, Jr.
*Attorney, Agent, or Firm*—Kenyon & Kenyon

[57] ABSTRACT

In a medium-pressure steam turbine of single-flow chamber type design, for use as a ship's turbine, cooling steam is conveyed via holes in the wall of the inflow part for cooling the rotor surface and the first few rows of rotor blades. The cooling steam is guided by a baffle at the wall of the inflow part to annular spaces between the shaft seal of the guide vanes and the rotor surface and via axial cooling ducts in the rotor to the bases of the rotor blades. At each rotor blade of the rows connected by the axial cooling ducts, radial connecting canals are provided in the blade bases for guiding the cooling steam into axial canals which connect the annular spaces under the shaft seals of the adjacent guide vanes.

6 Claims, 4 Drawing Figures

MEDIUM-PRESSURE STEAM TURBINE

BACKGROUND OF THE INVENTION

This invention relates to a medium-pressure steam turbine, particularly of the single-flow type for use in a high-temperature steam turbine system having a reheater.

Such medium-pressure steam turbines are known, in which cooling steam is fed via holes in the steam chest to an annular spaced located above the rotor surface and defined by a baffle which extends axially (as defined by the axis of rotation of the rotor) from the stuffing gland on one side to an axial extension of the first guide vanes on the other side, this extension forming the shaft seal at the input end of the turbine. The rotor blades of at least the first few rows are provided with canals extending parallel to the rotor rotation axis which are located above the rotor surface and interconnect annular spaces bounded in a radial direction by the shaft seals of the adjacent guide vanes and the rotor surface and in the axial direction by successive turbine blade rows.

A medium-pressure steam turbine which receives cooling steam from the reheater prior to reheating of the steam is described by W. Traupel in "Thermal Turbo-Machines," Vol. II, 2d Edition, 1968, pages 341 to 342. The relatively low-temperature steam for cooling the rotor is fed into an annular space adjacent to the stuffing gland and formed by recesses in the housing of the inlet part and the rotor, this cooling steam in part also serving a sealing function. The baffle, closely juxtaposed to the rotor surface, separates a region from the free steam chest for the working steam in the inlet part and conducts therein part of the cooling steam along the rotor surface up to an extension of the first guide vane, this extension forming the shaft seal and the inner termination point of the baffle. In this manner the cooling steam reaches the vicinity of the first rows of blades. However, heat is transferred to the cooling steam from the in-flowing driving steam, which with its 580° C. temperature is approximately 150° C. hotter than the cooling steam, through the thin wall of the baffle, whereby the cooling steam is already heated up before it reaches the blades. The blade bases of the first two rows of rotor blades are formed with axial canals located above the rotor surface so that the cooling steam provides a cooler under-current at least as far as the third guide vane for reducing the temperatures of the rotor surface at these highly stressed points. With such a turbine design the rotor in high-temperature steam turbines can be fabricated from a ferritic material instead of austenitic steel which has unfavorable thermal expansion characteristics and production requirements.

An object of the invention is to provide an improved medium-pressure steam turbine of the above-described type, in which the thermally induced stress of the rotor in the region of the first rows of blades is further reduced by the additional cooling steam, in order to retain the advantage of using ferritic or martensitic materials at still higher live-steam temperatures.

SUMMARY OF THE INVENTION

In a medium-pressure steam turbine according to the invention the inner wall of the driving-steam inlet extends to the shaft seal of the first guide vane and carries the baffle on its surface facing the rotor. The rotor body contains eccentrically disposed axially extending cooling ducts which, at least in the first rows of the rotor blades, establish communicating channels between the blade bases of adjacent rotor blades. Radial connecting canals which open into the axial canals of the rotor blades are provided in the blade bases of the rotor blades of the first rows.

The driving steam is fed or transported from the system's reheater to the inlet canal of the medium-pressure steam turbine, while the low-temperature steam flows at a relatively high velocity in the narrow annular space between the baffle and the rotor surface. Heat transfer to the cooling steam is reduced owing to the thickness of the wall of the steam chest which wall is located between the rotor surface and the inlet canal of the reheated working steam. Heating of the cooling steam by the driving steam is further reduced owing to spaces remaining between the baffle and the wall, these spaces being filled with air or steam. The cooling steam acts on the entire rotor surface between the stuffing gland and the shaft seal of the first row of guide vanes as if by a veil. The cooling steam in the thin annular space under the baffle is set in rotation owing to the small distance of the baffle from the rotor surface. The imparted angular momentum facilitates the entry of the cooling steam into the axial cooling ducts in the rotor body which ducts connect the blade bases of the first rows of rotor blades to each other. In the region of the blade bases the cooling steam is again distributed in ring-fashion along the rotor blade mounting recesses or slots over the entire circumference of the rotor. Owing to the radial connecting canals in each rotor blade of the first rows, each such individual rotor blade and the adjacent rotor region is effectively cooled. The cooling of these components and in particular of the outer rotor surface is enhanced by the transport of the cooling steam into the axial canals from the radial canals of the rotor blades and by the mixing there of this cooling steam with the cooling steam portion coming from the first shaft seal. The cooling steam is gradually mixed with the active steam flow via the axial canals under the shaft seals, without the danger that an interfering secondary flow can develop which would have an adverse effect on efficiency.

In this manner, in spite of the high temperature of the working steam in the steam chest, the temperatures of the rotor surface and the rotor blade bases of the highly stressed rows of rotor blades are reduced so much that the use of highly heat resistant austenitic steel for the rotor is obviated.

In a medium-pressure steam turbine according to the present invention, difficulties arising from the different thermal expansion rates of the different materials in the housing are avoided. In the prior art medium-pressure turbines, these difficulties can be substantial because of the heat cycles.

Another advantage inherent in the present invention is the improvement in the stiffness of the rotor due to the low temperature which prevails over a relatively wide region of the rotor (from the third row of rotor blades to the exit of the stuffing gland). This improved rotor stiffness results in a more advantageous location of the flexure-critical speed in the case of a thicker rotor body than would be possible if austenitic steel were used. Because of the improved rotor stability (gap excitation and oil film excitation), the efficiency of blade plan also in a chamber-type turbine can be increased.

The cooling of the medium-pressure steam turbine component of a high-pressure system, in accordance with the present invention, can be used in stationary installations as well as ships' turbines in order to improve process efficiency by enabling utilization of higher live-steam temperatures. Especially in the case of ships' turbines, as well as all small high-speed machines having relatively high load change rates and speed changes, the improvements in cooling owing to the present invention are particularly advantageous because of enhanced safety and because the rotor may be made of ferritic or martensitic steel instead of austenitic steel, thereby enabling turbine operation in the region of permissible thermal stresses.

The axial canals and the radial connecting canals in the blade bases of the rotor blades may take the form of holes or ducts. However, it is preferable to design these canals as laterally open elongate recesses or grooves because they can then be produced by a simple milling process. Furthermore, the holes or ducts for feeding the cooling steam to the annular space between the baffle and the rotor surface are preferably located in the lower parting gap flanges of the housing and the steam chest, since in this case the lines need not be separated when the upper housing part is uncovered.

DETAILED DESCRIPTION

Figure 1:
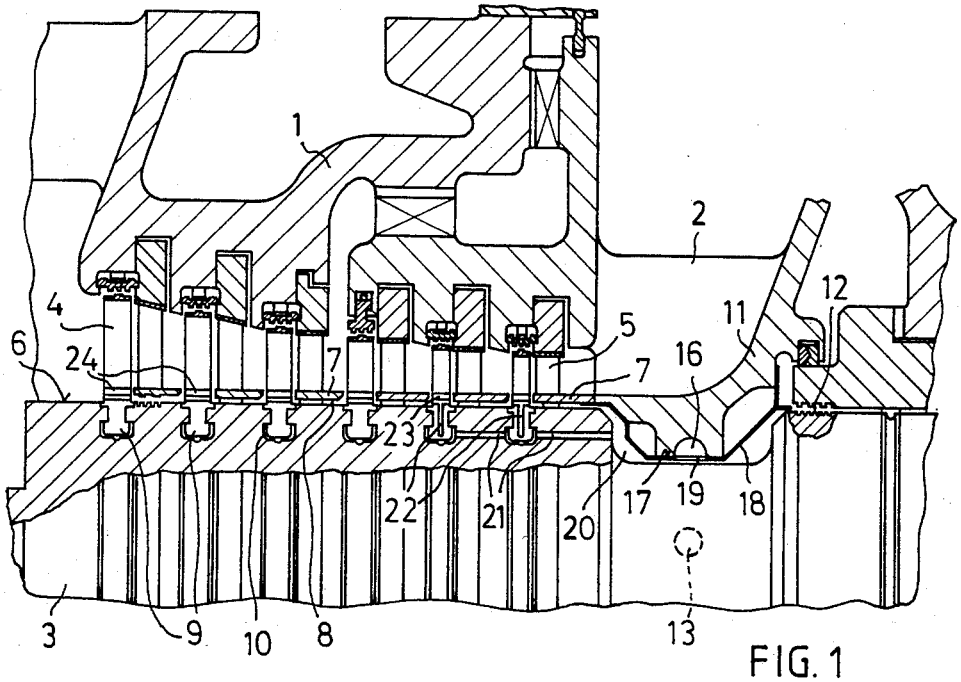
FIG. 1 is a partial longitudinal cross-section view of a medium-pressure steam turbine in accordance with the present invention.

The drawing illustrates a medium-pressure steam turbine of the single-flow chamber type for use in a high-temperature steam turbine installation having a reheater, which installation is utilizable as a ship's turbine. A housing 1 with a driving steam inlet part 2 surrounds a drum-type rotor 3 carrying six rows of rotor blades 4. In front of each row of rotor blades 4 is disposed a guide vane bottom 5 fastened to housing 1. Each guide vane bottom 5 is provided on a side facing an outer rotor surface 6 with a shaft seal 7 in the form of an axial extension which extends forwardly up to the adjacent rotor blade 4 and thereby defines an annular space 8 above rotor surface 6. Rotor blades 4 have base portions 9 inserted into annular slots or recesses 10 of rotor 3.

Inlet part 2 has an inner wall 11 extending to the shaft seal 7 of the guide vane bottom 5 of the first row. On a side of wall 11 opposite the driving steam intake port is located a stuffing gland 12.

Figure 2:
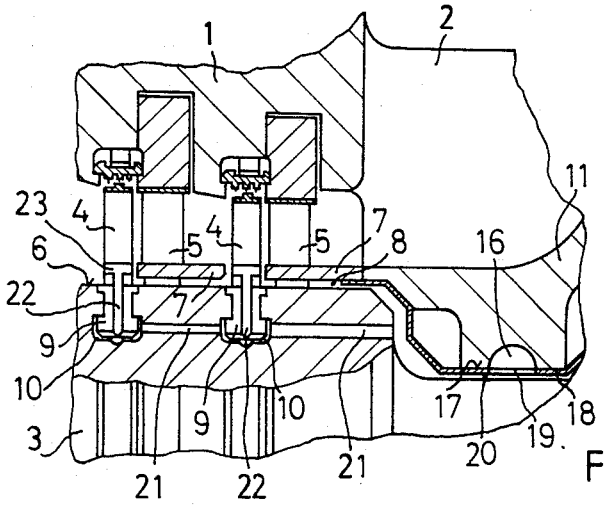
FIG. 2 is a detail of FIG. 1, on an enlarged scale.
Figure 3:
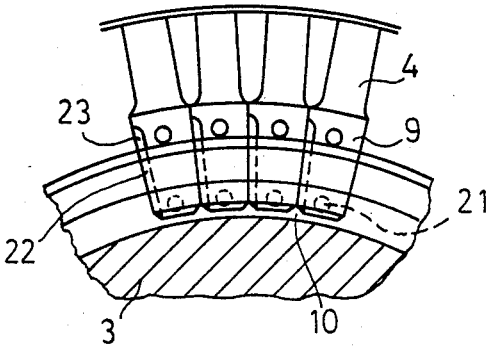
FIG. 3 is a partial transverse cross-section view onto the first row of rotor blades of the medium-pressure turbine of FIGS. 1 and 2.
Figure 4:
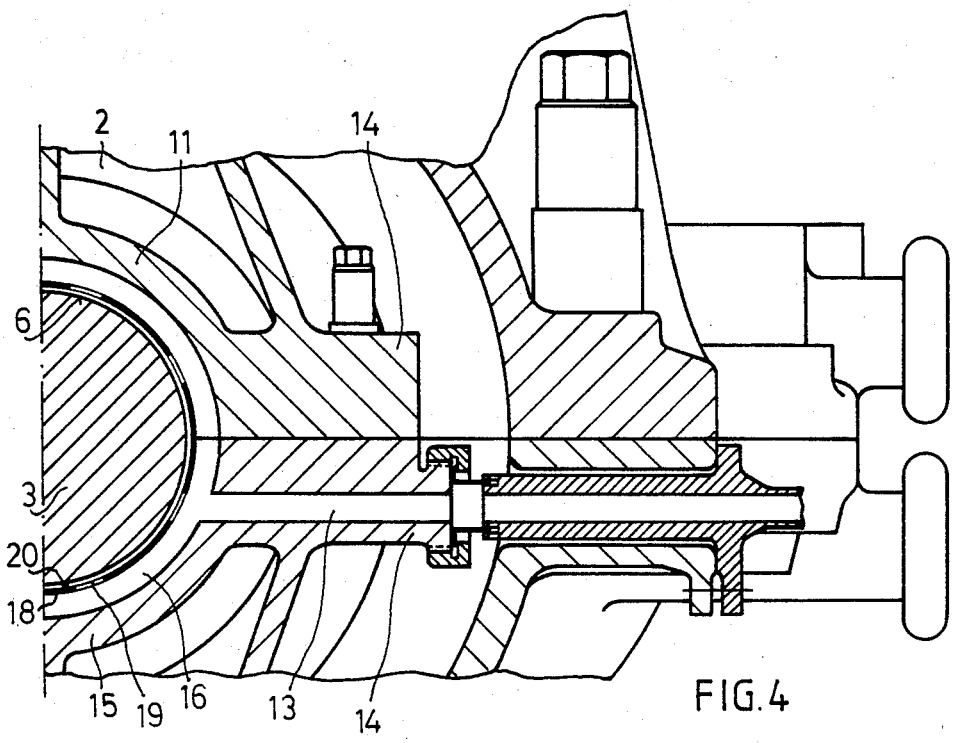
FIG. 4 a partial transverse or radial cross-section view through the flanges of the housing and the inlet part of the medium-pressure turbine of FIGS. 1–3.

In a high-temperature steam turbine installation, the working steam fed to the medium-pressure steam turbine from the reheater has a very high temperature, e.g., 600° C. For this reason the components of the medium-pressure turbine which first come into contact with the working steam, such as wall 11 or inlet part 2, the first guide vane bottoms 5, the first row of rotor blades 4 and the rotor region at the input end of the turbine, are very highly stressed. So that the temperature increases occurring at the steam input of the turbine can be absorbed even with ferritic or martensitic materials, separate cooling is provided by feeding to the turbine relatively low-temperature steam which is tapped after leaving the high-pressure turbine and before entering the reheater. This cooling steam is transported to the medium pressure turbine via a controlled reducing valve (not illustrated) and via holes or ducts 13 located in lower parting gap flanges 14 of a lower housing section 15 of inflow part 2, as shown in FIG. 4. Holes 13 communicate with a ring canal 16 (FIGS. 1, 2 and 4) which is open toward rotor 3. Lower housing 15 and wall 11 of inflow part 2 support, on an inner surface 17 facing the outer surface 6 of rotor 3, a baffle 18 formed with openings 19 for the passage of cooling steam in the region of ring canal 16. This baffle 18 extends from the stuffing gland 12, on one side, to the shaft seal 7 of the first guide vane bottom 5, on the other side. It defines an annular space 20 located above rotor surface 6.

The relatively low-temperature steam flowing into annular space 20 via the ring canal 16 is divided there into a cooling steam stream proper for cooling the active rotor portion, and into sealing steam for stuffing gland 12. The cooling steam is distributed by ring canal 16 over the entire housing or rotor circumference and forms in annular space 20 a cold steam veil which flows over rotor surface 6. Because baffle 18 is closely juxtaposed to rotor surface 6, the cooling steam is accelerated in the circumferential direction in the annular space 20 and thereby set in rotation.

Rotor 3 of the medium-pressure steam turbine contains axial cooling holes or ducts 21 distributed about the periphery of rotor 3. Ducts 21 are located at the height of bases 9 of rotor blades 4 and interconnect the slots 10 in which the bases of the first two rows of blades are inserted. In both of these rows, the blade base 9 of each rotor blade 4 is provided with a laterally open radially extending elongate recess 22 which communicates with a respective axial canal 23 located above rotor surface 6 and extending parallel to an axis of rotation of rotor 3, the axial canal 23 serving to interconnect consecutive annular spaces 8 defined by the shaft seals 7 of adjacent guide vein bottoms 5 and by rotor surface 6. These axial canals 23 perform the further function of the equalization holes customary in a chamber-type turbine. For this reason, rotor blades 4 in other rows also have corresponding axial canals 23.

A portion of the cooling steam contained in annular space 20 in front of the first guide vane bottom 5 enters annular spaces 8 below the shaft seals 7 of the guide vane bottoms 5 and flows along rotor surface 6. Another portion of the cooling steam, aided by the rotation thereof, enters axial cooling ducts 21 and is fed to the annular slots 10 corresponding to the two first rows of rotor blades 4. In each of these first two rows, the cooling steam is distributed along rotor slots 10 over the entire circumference of rotor 3 and flows through radial connecting canals 22 and axial canals 23 to rejoin the other portion of the cooling steam. In addition to cooling rotor surface 6, the low-temperature steam effects a cooling of bases 9 of rotor blades 4 and of the adjacent part of the rotor.

The division of the cooling steam streams depends on the cross-section dimensions of axial cooling ducts 21 and of annular spaces 8, as well as on their manufacturing tolerances. The cross sections and pressure conditions are chosen so that the cooling effect is still only small after the second row of rotor blades 4 and so that thorough mixing of the cooling steam with the active working steam occurs without the transition of the cooling steam into the working steam which takes place in the annular spaces 8, and without generating a secondary flow which could have an adverse effect on efficiency. By a cooling of the highly stressed active parts of rotor 3 in accordance with this invention, a sufficiently great cooling effect is obtained with small quantities of cooling steam at the points of highest stress, so that the high temperature strength limits of ferritic or martensitic steel used for rotor 3 are not exceeded.

What is claimed is:

1. In a medium-pressure steam turbine of the single-flow type for use in a high-temperature steam turbine installation having a reheater and vapor transport means for feeding cooling steam to said medium-pressure steam turbine, said medium-pressure steam turbine having an output end and an input end, an inflow part with a housing and a flow wall, a multiplicity of rotor blades arranged in a plurality of rows, a multiplicity of guide vanes arranged in rows alternating in an axial direction with said rows of rotor blades, a rotor with an outer surface, a baffle extending radially above said rotor and defining with said outer surface thereof a first annular space, said guide vanes being provided with shaft seals in the form of axial extensions juxtaposed to said outer surface of said rotor and defining therewith respective second annular spaces, said rotor blades having bases and said rotor having recesses, said bases being inserted in said recesses, said baffle extending from a stuffing gland on one side to the shaft seal of a first row of said guide vanes on the other side, the rotor blades in at least a plurality of consecutive rows at said input end of said medium-pressure turbine being provided with axial canals disposed above said outer surface of said rotor for interconnecting consecutive ones of said second annular spaces, the improvement wherein:

(a) the flow wall of the inflow part extends to the shaft seal of the first row of guide vanes at the input end of the turbine;

(b) said flow wall has an inner surface facing the outer surface of the rotor and carrying the baffle;

(c) said rotor has a plurality of axial cooling ducts extending from the first annular space to recesses containing the bases of rotor blades in at least the first row of rotor blades at said input end of the turbine; and (d) the bases of the rotor blades in at least said first row of rotor blades are formed with radial connecting canals communicating with the axial canals of the respective rotor blades.

2. The improvement defined in claim 1 wherein the housing of said inflow part of the turbine has an upper parting gap flange and a lower parting gap flange and said lower parting gap flange is provided with holes communicating at least indirectly with said first annular space for introducing cooling steam thereinto.

3. The improvement defined in claim 2 wherein said axial canals and said radial canals are in the form of laterally open elongate recesses.

4. The improvement defined in claim 3 wherein said medium pressure steam turbine is of the chamber type.

5. The improvement defined in claim 1 wherein said axial canals and said radial canals are in the form of laterally open elongate recesses.

6. The improvement defined in claim 1 wherein said medium pressure steam turbine is of the chamber type.

* * * * *